US012152216B2

(12) United States Patent
Capitosti et al.

(10) Patent No.: US 12,152,216 B2
(45) Date of Patent: Nov. 26, 2024

(54) BENZAZEPINE COMPOUNDS AS ANTIOXIDANTS FOR LUBRICANT COMPOSITIONS

(71) Applicant: The Lubrizol Corporation, Wickliffe, OH (US)

(72) Inventors: Scott Capitosti, Perry, OH (US); Daniel J. Saccomando, Belper (GB); Thomas S. Corrigan, Lakewood, OH (US); Zack Palchak, Wickliffe, OH (US); Richard J. Myerson, Belper (GB); Zach Rodgers, Wickliffe, OH (US); Jason J. Hanthorn, Eastlake, OH (US); Christopher M. Rasik, Cleveland, OH (US); Binbin Guo, Sagamore Hills, OH (US); Yanshi Zhang, Solon, OH (US); William R. S. Barton, Belper (GB)

(73) Assignee: The Lubrizol Corp tion, Wickliffe, OH (US)

( * ) Notice: Subject to any disclaimer, the term of this patent is extended or adjusted under 35 U.S.C. 154(b) by 0 days.

(21) Appl. No.: 18/269,188

(22) PCT Filed: Dec. 22, 2021

(86) PCT No.: PCT/US2021/064771

§ 371 (c)(1),
(2) Date: Jun. 22, 2023

(87) PCT Pub. No.: WO2022/140496

PCT Pub. Date: Jun. 30, 2022

(65) Prior Publication Data

US 2024/0052256 A1 Feb. 15, 2024

Related U.S. Application Data

(60) Provisional application No. 63/130,050, filed on Dec. 23, 2020.

(51) Int. Cl.

| | |
|---|---|
| ***C10M 133/38*** | (2006.01) |
| ***C10M 129/70*** | (2006.01) |
| ***C10M 133/12*** | (2006.01) |
| ***C10M 139/00*** | (2006.01) |
| ***C10M 141/12*** | (2006.01) |
| ***C10M 143/14*** | (2006.01) |
| ***C10M 145/20*** | (2006.01) |

(Continued)

(52) U.S. Cl.

CPC ..... *C10M 133/38* (2013.01); *C10M 129/70* (2013.01); *C10M 133/12* (2013.01); *C10M 139/00* (2013.01); *C10M 141/12* (2013.01); *C10M 143/14* (2013.01); *C10M 145/20* (2013.01); *C10M 161/00* (2013.01); *C10M 2205/08* (2013.01); *C10M 2207/284* (2013.01); *C10M 2209/101* (2013.01); *C10M 2215/064* (2013.01); *C10M 2215/22* (2013.01); *C10M 2219/022* (2013.01); *C10M 2219/046* (2013.01); *C10M 2227/06* (2013.01); *C10M 2227/061* (2013.01); *C10M 2290/02* (2013.01); *C10N 2010/04* (2013.01); *C10N 2010/06* (2013.01); *C10N 2020/02* (2013.01); *C10N 2030/04* (2013.01); *C10N 2030/06* (2013.01); *C10N 2030/45* (2020.05); *C10N 2040/25* (2013.01); *C10N 2060/10* (2013.01); *C10N 2060/14* (2013.01)

(58) Field of Classification Search

CPC ..... C10M 133/38; C10M 129/70; C10M 133/12; C10M 139/00; C10M 141/12; C10M 143/14; C10M 145/20; C10M 161/00; C10M 2205/08; C10M 2207/284; C10M 2209/101; C10M 2215/064; C10M 2215/22; C10M 2219/022; C10M 2219/046; C10M 2227/06; C10M 2227/061; C10M 2290/02; C10M 2215/225; C10N 2010/04; C10N 2010/06; C10N 2020/02; C10N 2030/04; C10N 2030/06; C10N 2030/45; C10N 2040/25; C10N 2060/10; C10N 2060/14; C10N 2030/10

See application file for complete search history.

(56) References Cited

U.S. PATENT DOCUMENTS

| | | | |
|---|---|---|---|
| 3,172,892 | A | 3/1965 | Le Suer et al. |
| 4,234,435 | A | 11/1980 | Meinhardt et al. |

(Continued)

FOREIGN PATENT DOCUMENTS

| | | |
|---|---|---|
| CN | 105566223 | 5/2016 |
| EP | 0355895 | 1/1991 |

(Continued)

OTHER PUBLICATIONS

Joydev K. Laha, K.S. Satyanarayana Tummalapalli and Ankur Gupta; "Mechanistic Insights into the Palladium-Catalyzed Domino Synthesis of 10,11-Dihydro-5H-dibenzo[b,e][1,4]diazepines," European Journal of Organic Chemistry, 2014, pp. 4773-4779, Wiley-VCH Verlag GmbH & Co KGaA, Weinheim.

(Continued)

*Primary Examiner* — Cephia D Toomer
(74) *Attorney, Agent, or Firm* — Vincent A. Cortese; Michael A. Miller

(57) ABSTRACT

A lubricating composition including an oil of lubricating viscosity and a benzazepine compound. Methods of using such lubricating compositions are also disclosed.

14 Claims, No Drawings

(51) Int. Cl.

| | |
|---|---|
| ***C10M 161/00*** | (2006.01) |
| *C10N 10/04* | (2006.01) |
| *C10N 10/06* | (2006.01) |
| *C10N 20/02* | (2006.01) |
| *C10N 30/00* | (2006.01) |
| *C10N 30/04* | (2006.01) |
| *C10N 30/06* | (2006.01) |
| *C10N 40/25* | (2006.01) |
| *C10N 60/10* | (2006.01) |
| *C10N 60/14* | (2006.01) |

(56) References Cited

U.S. PATENT DOCUMENTS 4,863,623 A 9/1989 Nalesnik
5,444,135 A * 8/1995 Cheradame ..... C10M 177/00 526/346
6,107,257 A 8/2000 Valcho et al.
6,117,825 A 9/2000 Liu et al.
6,355,839 B1 3/2002 Onopchenko
6,930,183 B2 8/2005 Duyck et al.
7,329,772 B2 2/2008 Baranski
7,339,003 B2 3/2008 Aldrich et al.
7,390,928 B2 6/2008 Hobbs et al.
7,407,919 B2 8/2008 Wilk et al.
7,413,682 B2 8/2008 Dibella
7,501,386 B2 3/2009 Cherpeck et al.
7,504,510 B2 3/2009 Meier et al.
7,531,487 B2 5/2009 Al-Akhdar et al.
7,538,076 B2 5/2009 Brown et al.
7,586,007 B2 9/2009 Patil et al.
7,608,568 B2 10/2009 Ma
7,615,521 B2 11/2009 Eveland et al.
7,618,467 B2 11/2009 Muir
7,625,849 B2 12/2009 Malz et al.
7,683,017 B2 3/2010 Cherpeck et al.
7,691,793 B2 4/2010 Muir
7,704,929 B2 4/2010 Nalesnik
7,704,931 B2 4/2010 Dong et al.
7,759,295 B2 7/2010 Patil et al.
7,767,853 B2 8/2010 Cholli et al.
7,838,703 B2 11/2010 Ma et al.
7,846,884 B2 12/2010 Ma
7,847,030 B2 12/2010 Patil
7,847,125 B2 12/2010 Ma et al.
7,858,565 B2 12/2010 Tynik et al.
7,884,059 B2 2/2011 Gatto et al.
7,897,552 B2 3/2011 Ellington et al.
7,902,280 B2 3/2011 Gelbin et al.
7,906,467 B2 3/2011 Dibella
7,928,045 B2 4/2011 Dong et al.
7,928,265 B2 4/2011 Andruskova et al.
7,932,218 B2 4/2011 Chasan et al.
7,935,663 B2 5/2011 Chase et al.
7,960,321 B2 6/2011 Gatto et al.
7,977,286 B2 7/2011 Patil et al.
7,988,884 B2 8/2011 Gatto et al.
7,989,407 B2 8/2011 Habeeb et al.
8,003,583 B2 8/2011 Cherpeck et al.
8,017,805 B2 9/2011 Nalesnik
8,030,257 B2 10/2011 Habeeb et al.
8,030,259 B2 10/2011 Aebli et al.
8,048,831 B2 11/2011 Loper
8,048,833 B2 11/2011 Habeeb et al.
8,067,347 B2 11/2011 Ruhe, Jr. et al.
8,076,275 B2 12/2011 Ruhe, Jr. et al.
8,080,500 B2 12/2011 Ravichandran et al.
8,093,190 B2 1/2012 Chase et al.
8,110,532 B2 2/2012 Dong
8,138,130 B2 3/2012 Nelson et al.
8,183,189 B2 5/2012 Chen et al.
8,242,066 B2 8/2012 Cheng et al.
8,278,253 B2 10/2012 Habeeb
8,299,003 B2 10/2012 Degonia et al.
8,318,645 B2 11/2012 Kamimura
8,318,646 B2 11/2012 Andrews et al.
8,349,881 B2 1/2013 Gradtke et al.
8,394,747 B2 3/2013 Harrison et al.
8,455,681 B2 6/2013 Harrison et al.
8,466,319 B2 6/2013 Banavali et al.
8,530,397 B2 9/2013 Bera et al.
8,557,753 B2 10/2013 Gieselman et al.
8,563,489 B2 10/2013 Rowland et al.
8,580,718 B2 11/2013 Sabahi
8,592,356 B2 11/2013 Ito
8,603,955 B2 12/2013 Yagishita
8,618,031 B2 12/2013 Douglass et al.
8,623,798 B2 1/2014 Cherpeck et al.
8,637,437 B2 1/2014 Gieselman et al.
8,669,386 B2 3/2014 Boudreau, Sr.
8,680,030 B2 3/2014 Cartwright
8,703,682 B2 4/2014 Hartley et al.
8,710,266 B2 4/2014 Kumar et al.
8,741,824 B2 6/2014 Malandro et al.
8,933,004 B2 1/2015 Liu et al.
8,987,515 B2 3/2015 Rowland
8,999,903 B2 4/2015 Arrowsmith et al.
9,068,136 B2 6/2015 Ohno et al.
9,085,743 B2 7/2015 Yoon et al.
9,193,931 B2 11/2015 Nelson et al.
9,200,228 B2 12/2015 Boudreau
9,206,373 B2 12/2015 McLaughlin et al.
9,212,331 B2 12/2015 Beilfuss et al.
9,228,150 B2 1/2016 Aguilar et al.
9,238,783 B2 1/2016 Elomari et al.
9,243,201 B2 1/2016 Patil et al.
9,243,202 B2 1/2016 Mosier et al.
9,249,091 B2 2/2016 Gibbs et al.
9,249,347 B2 2/2016 Minor et al.
9,249,372 B2 2/2016 Davies et al.
9,255,058 B2 2/2016 Kawata et al.
9,255,237 B2 2/2016 Tatsumi et al.
9,267,093 B2 2/2016 Iyer et al.
9,273,259 B2 3/2016 Sunkara et al.
9,303,293 B2 4/2016 Parodi et al.
9,309,452 B2 4/2016 Elomari et al.
9,309,480 B2 4/2016 Loop et al.
9,315,707 B2 4/2016 Kaneko
9,315,755 B2 4/2016 Tang et al.
9,315,756 B2 4/2016 Patil et al.
9,315,759 B2 4/2016 Lange et al.
9,315,760 B2 4/2016 Chase et al.
9,315,761 B2 4/2016 Patil et al.
9,321,980 B2 4/2016 Ricks
9,321,981 B2 4/2016 Kasai
9,328,306 B2 5/2016 Kishi et al.
9,334,203 B2 5/2016 Small et al.
9,334,347 B2 5/2016 Dibiase et al.
9,334,461 B2 5/2016 Wirtensohn et al.
9,334,462 B2 5/2016 Bouffet et al.
9,340,745 B2 5/2016 Rabbat et al.
9,340,746 B1 5/2016 Henly et al.
9,347,016 B2 5/2016 Fu et al.
9,347,017 B2 5/2016 Vilardo et al.
9,347,019 B2 5/2016 Shaw et al.
9,359,570 B2 6/2016 Lange et al.
9,359,573 B2 6/2016 Baker, Jr. et al.
9,362,980 B2 6/2016 Han et al.
9,365,484 B2 6/2016 Nakayama et al.
9,365,795 B2 6/2016 Gauthier et al.
9,365,796 B2 6/2016 Bredsguard
9,368,150 B2 6/2016 Karis
9,371,500 B2 6/2016 Zehler
9,371,501 B2 6/2016 Shiflett et al.
9,376,359 B2 6/2016 Mahieux et al.
9,382,490 B2 7/2016 Brewer et al.
9,382,498 B2 7/2016 Tatsumi et al.
9,386,643 B2 7/2016 Feri et al.
9,388,120 B2 7/2016 Kumar et al.
9,388,435 B2 7/2016 Franklin et al.
9,394,500 B2 7/2016 Mikami et al.
9,394,501 B2 7/2016 Forest et al.
9,399,748 B2 7/2016 Ariyasu et al.
9,416,330 B2 8/2016 Titley

(56) References Cited

U.S. PATENT DOCUMENTS

| | | | |
|---|---|---|---|
| 9,422,497 | B2 | 8/2016 | Patil et al. |
| 9,422,498 | B2 | 8/2016 | Patil et al. |
| 9,422,499 | B2 | 8/2016 | Patil et al. |
| 9,422,501 | B2 | 8/2016 | Yagishita |
| 9,422,502 | B2 | 8/2016 | Patil et al. |
| 9,434,675 | B2 | 9/2016 | Frey et al. |
| 9,434,905 | B2 | 9/2016 | Mosleh |
| 9,434,906 | B2 | 9/2016 | Jukes et al. |
| 9,441,183 | B1 | 9/2016 | Bulluck et al. |
| 9,458,401 | B2 | 10/2016 | Strittmatter et al. |
| 9,458,402 | B2 | 10/2016 | Takekawa |
| 9,458,403 | B2 | 10/2016 | Patil et al. |
| 9,458,405 | B2 | 10/2016 | Sakanoue et al. |
| 9,458,407 | B2 | 10/2016 | Vijayendran et al. |
| 9,464,255 | B2 | 10/2016 | Brekan et al. |
| 9,464,256 | B2 | 10/2016 | Laufer et al. |
| 9,469,583 | B2 | 10/2016 | Aalto et al. |
| 9,469,823 | B2 | 10/2016 | Gieselman et al. |
| 9,469,824 | B2 | 10/2016 | Delbridge et al. |
| 9,469,825 | B2 | 10/2016 | Tang |
| 9,481,696 | B1 | 11/2016 | Edwards et al. |
| 9,481,850 | B2 | 11/2016 | Brekan et al. |
| 9,487,729 | B2 | 11/2016 | Haque et al. |
| 9,493,694 | B2 | 11/2016 | Kaneko et al. |
| 9,499,766 | B2 | 11/2016 | Malshe et al. |
| 9,506,008 | B2 | 11/2016 | Gaal et al. |
| 9,506,009 | B2 | 11/2016 | Dance et al. |
| 9,512,338 | B2 | 12/2016 | Krumm et al. |
| 9,512,380 | B2 | 12/2016 | Su et al. |
| 9,518,242 | B1 | 12/2016 | Edwards et al. |
| 9,518,244 | B2 | 12/2016 | Bloch et al. |
| 9,523,027 | B2 | 12/2016 | Minor |
| 9,523,060 | B2 | 12/2016 | Cholli et al. |
| 9,528,037 | B2 | 12/2016 | Thomas et al. |
| 9,528,068 | B2 | 12/2016 | Davies et al. |
| 9,528,069 | B2 | 12/2016 | Price et al. |
| 9,528,071 | B2 | 12/2016 | Hogendoorn et al. |
| 9,528,074 | B2 | 12/2016 | Hogendoorn et al. |
| 9,534,187 | B2 | 1/2017 | Capitosti et al. |
| 9,631,159 | B2 | 4/2017 | Mosier et al. |
| 9,771,541 | B2 | 9/2017 | Ivancic et al. |
| 10,364,402 | B2 | 7/2019 | Salem et al. |
| 10,487,043 | B2 | 11/2019 | Rowland |
| 2004/0214813 | A1* | 10/2004 | Duyck ..... C07D 223/22 540/550 |

FOREIGN PATENT DOCUMENTS

| | | |
|---|---|---|
| EP | 2614131 | 7/2013 |
| EP | 3024916 | 6/2016 |
| WO | 2006/015130 | 2/2006 |
| WO | 2008/147704 | 12/2008 |
| WO | 2019/034584 | 2/2019 |

OTHER PUBLICATIONS

I.G. Cadogan, David S.B. Grace, Peter K.K. Lim, and Brian S. Tait, "Reduction of Nitro- and Nitroso-compounds by Tervalent Phosphorus Reagents. Part XIII. Conversion of Aryl 2-Nitroaryl Ethers into Novel 3-Aryl-2,3-dihydro-1,3,2-benzoxazaphosph(v)oles t (Oxazaphosphoranes) and their 2-Oxo-derivatives," Journal of the Chemical Society, Jan. 1, 1975, pp. 2376-2385, Royal Society of Chemistry, Cambridge, UK.

L.A. Farmer, E.A. Haidasz, M. Greisser, and D.A. Pratt, "Phenoxazine; A Priveleged Scaffold for Radical-Trapping Antioxidants" Journal of Organic Chemistry, 2017, pp. 10523-10536, 82, ACS Publications.

* cited by examiner

BENZAZEPINE COMPOUNDS AS ANTIOXIDANTS FOR LUBRICANT COMPOSITIONS

This application is a national-phase filing of PCT Application No. PCT/US2021/064771, filed on Dec. 22, 2021, which claims the benefit of U.S. Provisional Application No.

The disclosed technology relates to compositions suitable for use as lubricants and lubricant additive compositions which comprise a benzazepine-derived antioxidant, wherein the antioxidant itself may also be described as a benzazepine compound, and optionally comprising other additives suitable for lubricants, such as an anti-wear agent, a detergent, or a dispersant.

Antioxidants are an important class of additives since they are used to provide and/or improve the anti-oxidation performance of organic compositions, including lubricant compositions that contain organic components, by preventing or retarding oxidative and thermal decomposition. Antioxidants in some applications can result in an increase in volatility which can be undesirable due to required environmental regulations and/or performance standards.

It is known to use substituted diarylamine compounds in an oil of lubricating viscosity to reduce oxidation breakdown and improve cleanliness.

The subject matter described herein provides an ashless antioxidant which has suitable performance properties when used in lubricant formulations, especially for heavy duty diesel engines and passenger car crankcase engines, for example, and which may also reduce regulatory concerns.

Provided is a lubricating composition comprising an oil of lubricating viscosity and a benzazepine compound. In certain embodiments, the benzazepine compound is an ashless benzazepine compound. In certain embodiments, provided is a lubricating composition comprising an oil of lubricating viscosity and an ashless antioxidant, wherein the ashless antioxidant comprises a benzazepine compound. In certain embodiments, provided is a lubricating composition comprising an oil of lubricating viscosity and an ashless antioxidant, wherein the ashless antioxidant consists essentially of a benzazepine compound. In certain embodiments, provided is a lubricating composition comprising an oil of lubricating viscosity and an ashless antioxidant, wherein the ashless antioxidant consists of a benzazepine compound. In certain embodiments, provided is a lubricating composition comprising an oil of lubricating viscosity and an ashless antioxidant, wherein the ashless antioxidant is a benzazepine compound.

The present subject matter further provides for lubricating compositions suitable for lubricating an internal combustion engine, comprising: (A) a major amount of an oil of lubricating viscosity; (B) a minor amount of at least one antioxidant comprising a benzazepine compound, as described herein; and (C) a minor amount of at least one other additive comprising at least one of viscosity modifiers, pour point depressants, dispersants, detergents, anti-wear agents, antioxidants different from the antioxidant of component (B), friction modifiers, corrosion inhibitors, seal swell agents, metal deactivators, or foam inhibitors.

The present subject matter further provides methods of lubricating an internal combustion engine, wherein the methods comprise the step of supplying to the engine any of the lubricating compositions described herein. Such methods may include a method for improving the oxidative stability of an engine oil lubricant (e.g., a crankcase lubricant).

The present subject matter further provides a method for lubricating an internal combustion engine, comprising: (A) supplying to said engine a lubricating composition comprising: (i) an oil of lubricating viscosity; (ii) a minor amount of at least one antioxidant comprising a benzazepine compounds, as described herein; and (iii) a minor amount of at least one other additive comprising at least one of viscosity modifiers, pour point depressants, dispersants, detergents, anti-wear agents, antioxidants that are different from the antioxidant of component (ii), friction modifiers, corrosion inhibitors, seal swell agents, metal deactivators, or foam inhibitors.

The following embodiments of the present subject matter are contemplated:

1. A lubricating composition comprising an oil of lubricating viscosity and a benzazepine compound.

2. The lubricating composition of embodiment 1, wherein the benzazepine compound is substituted with a second aryl ring that shares two carbon atoms with a nitrogen-containing ring of the benzazepine compound.

3. The lubricating composition of either embodiment 1 or embodiment 2, wherein a nitrogen-containing ring of the benzazepine compound contains at least one additional heteroatom, wherein the heteroatom is at least one of oxygen, sulfur, or nitrogen.

4. The lubricating composition of any one of embodiments 1 to 3, wherein the benzazepine compound is represented by at least one of the following general formulae IA or IB:

IA

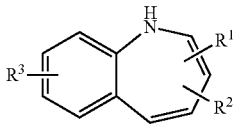

IB

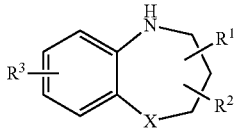

wherein $R^1$, $R^2$ and $R^3$ are each independently hydrogen or a hydrocarbyl group of 1 to 24 carbon atoms, or $R^1$ and $R^2$ together form a saturated five- or six-membered carbon ring, an unsaturated five- or six-membered carbon ring, or an aromatic ring, any of which is optionally further substituted with a hydrocarbyl group of 1 to 24 carbon atoms; each X is independently O, S, or $NR^4$; and $R^4$ is hydrogen or a hydrocarbyl group of 1 to 18 carbon atoms.

5. The lubricating composition of any one of embodiments 1 to 4, wherein the benzazepine compound comprises a dibenzazepine compound.

6. The lubricating composition of embodiment 5, wherein the dibenzazepine compound is represented by the at least one of the following general formulae IIA or IIB:

IIA

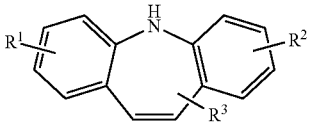

-continued

IIB

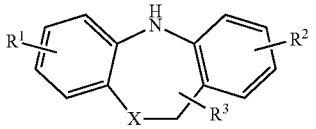

wherein $R^1$, $R^2$ and $R^3$ are each independently hydrogen or a hydrocarbyl group of 1 to 24 carbon atoms; each X is independently O, S, or $NR^4$; and $R^4$ is hydrogen or a hydrocarbyl group of 1 to 18 carbon atoms.

7. The lubricating composition of any one of embodiments 1 to 6, wherein the benzazepine compound is present in the lubricating composition in an amount 0.1 to 5.0 weight percent, or 0.5 to 3.0 weight percent, or 0.8 to 2.5 weight percent, based on the total weight of the lubricating composition.

8. The lubricating composition of any one of embodiments 1 to 7, wherein the lubricating composition comprises at least 0.3 weight percent of at least one additional lubricant additive comprising at least one of an ashless polyisobutenyl succinimide dispersant, an overbased or neutral metal-based detergent, an anti-wear agent, a polymeric viscosity modifier, or an ashless antioxidant different from the benzazepine compound.

9. The lubricating composition of embodiment 8, wherein the ashless polyisobutenyl succinimide dispersant is present in the lubricating composition in an amount of from 0.5 to 4.0 weight percent, or 0.8 to 3.0 weight percent, or 1.1 to 2.3 weight percent, or 1.5 to 2.8 weight percent, based on the total weight of the lubricating composition.

10. The lubricating composition of either embodiment 8 or embodiment 9, wherein the metal-based detergent comprises at least one of a neutral alkaline earth metal detergent or an overbased alkaline earth metal detergent, in an amount of from 0.2 to 15 weight percent, or 0.3 to 10 weight percent, or 0.3 to 8 weight percent, or 0.4 to 3 weight percent, based on the total weight of the lubricating composition.

11. The lubricating composition of embodiment 10, wherein the at least one of a neutral alkaline earth metal detergent or an overbased alkaline earth metal detergent comprises at least one of an alkylbenzene sulfonate detergent, a sulfur-coupled phenate detergent, or an alkylsalicylate detergent.

12. The lubricating composition of any one of embodiments 8 to 11, wherein at least one anti-wear agent is present in an amount of from 0.05 to 3 weight percent, or 0.08 to 1.3 weight percent, or 0.08 to 2.1 weight percent, or 0.1 to 1.5 weight percent, or 0.5 to 0.9 weight percent, based on the total weight of the lubricating composition.

13. The lubricating composition of embodiment 12, wherein the at least one anti-wear agent comprises a phosphorus-containing compound in an amount effective to deliver 200 to 1200 ppm phosphorus to the lubricating composition.

14. The lubricating composition of either embodiment 12 or embodiment 13, wherein the at least one anti-wear agent comprises a zinc dialkyl dithiophosphate.

15. The lubricating composition of embodiment 8, wherein the ashless antioxidant different from the benzazepine compound is present in an amount of from 0.01 to 5 weight percent, or 0.1 to 4 weight percent, or 0.2 to 3 weight percent, or 0.5 to 2 weight percent, based on the total weight of the lubricating composition.

16. The lubricating composition of any one of embodiments 1 to 15, wherein the lubricating composition comprises less than 0.1 weight percent of a diarylamine antioxidant.

17. The lubricating composition of any one of embodiments 1 to 16, wherein the lubricating composition is substantially free of a diarylamine antioxidant.

18. The lubricating composition of embodiment 1, wherein the benzazepine compound comprises at least one of: benzazepine; dihydro-benzazepine; tetrahydro benzazepine; 5H-dibenzo[b,f]azepine; 10,11-dihydro-5H-dibenzo[b,f]azepine; or hydrocarbyl-substituted derivatives thereof.

19. A method of lubricating an internal combustion engine comprising supplying to the internal combustion engine the lubricating composition of any one of embodiments 1 to 18.

20. A method of improving the oxidative resistance of a crankcase lubricant, wherein the method comprises lubricating the crankcase with the lubricating composition of any of embodiments 1 to 18.

Various features and embodiments of the present subject matter will be described below by way of non-limiting illustration.

The amount of each chemical component described herein is presented exclusive of any solvent or diluent oil, which may be customarily present in the commercial material, that is, on an active chemical basis, unless otherwise indicated. Unless otherwise indicated, each chemical or composition referred to herein should be interpreted as being a commercial grade material which may contain the isomers, byproducts, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); substituted hydrocarbon substituents, that is, substituents containing non-hydrocarbon groups which, in the context of the present subject matter, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of the present subject matter, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. For instance, metal ions (of, e.g., a detergent) may migrate to other acidic or anionic sites of other molecules. The products formed thereby, including the products formed upon employing the composition of the present subject matter in its intended use, may not be susceptible of easy description. Nevertheless, all such modifications and reaction products are included within the scope of the present subject matter; the present subject matter encompasses the composition prepared by admixing the components described herein.

As used herein, the indefinite article "a"/"an" is intended to mean one or more than one. As used herein, the phrase "at least one" means one or more than one of the following terms. Thus, "a"/"an" and "at least one" may be used interchangeably. For example "at least one of A, B or C" means that just one of A, B or C may be included, and any mixture of two or more of A, B and C may be included, in alternative embodiments.

As used herein, the term "substantially" means that a value of a given quantity is within ±10% of the stated value. In other embodiments, the value is within ±5% of the stated value. In other embodiments, the value is within ±2.5% of the stated value. In other embodiments, the value is within ±1% of the stated value.

As used herein, the term "substantially free of" means that a component does not include any intentional addition of the material which the component is "substantially free of". For example, the component may include a material which the component is "substantially free of" at no more than impurity levels, which may be the result of incomplete chemical reactions and/or unintended/undesired (but perhaps unavoidable) reaction products.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the essential or basic and novel characteristics of the composition or method under consideration.

The present subject matter relates to lubricating compositions comprising an oil of lubricating viscosity and an ashless antioxidant, wherein the ashless antioxidant comprises a benzazepine compound, and methods of using such lubricating compositions, such as methods of lubricating internal combustion engines utilizing such antioxidants. The lubricating compositions may include further lubricant additives as described herein.

The lubricating compositions described herein may find use in various applications as a lubricant composition for: internal combustion engines, including gasoline engines or spark-ignited engines, such as passenger car engines, diesel engines, or compression-ignited engines, such as heavy duty diesel truck engines, natural gas fueled engines, such as stationary power engines, two-cycle engines, aviation piston engines and turbine engines, marine and railroad diesel engines; power transmissions such as automatic transmission, transaxle transmissions, or farm tractor transmissions; gears, such as industrial gears or automotive gears; metalworking; hydraulic systems; special applications, such as bearings, which may require that the lubricating composition be a grease; and hydrocarbon fuels for an internal combustion engine such as a gasoline or diesel fuel.

One component of the lubricating compositions disclosed herein is an oil of lubricating viscosity. As used herein, an oil of lubricating viscosity may include natural and/or synthetic oils, oils derived from hydrocracking, hydrogenation, and/or hydrofinishing, unrefined oils, refined oils, re-refined oils or mixtures thereof. A more detailed description of unrefined oils, refined oils, and re-refined oils is provided in WO 2008/147704 A1, paragraphs [0054] to [0056]. A more detailed description of natural and synthetic lubricating oils is found in paragraphs [0058] and [0059] respectively of WO 2008/147704 A1. Synthetic oils may also be produced by Fischer-Tropsch reactions and may be hydroisomerized Fischer-Tropsch hydrocarbons or waxes. In certain embodiments, oils may be prepared by a Fischer-Tropsch gas-to-liquid synthetic procedure, as well as other gas-to-liquid procedures.

Suitable oils may be produced from biological (i.e., natural) sources or by bio-engineered processes. This includes both naturally-occurring oils, such as vegetable oils and triglyceride oils, which may be further refined or purified by standard processes, and those oils that may be derived by biological conversion of a natural chemical into oil directly or by bio-formation of building block pre-cursor molecules capable of being further converted into oil by known processes.

Oils of lubricating viscosity may also be defined as specified in the April 2008 version of "Appendix E—API Base Oil Interchangeability Guidelines for Passenger Car Motor Oils and Diesel Engine Oils", section 1.3 Subheading 1.3. "Base Stock Categories". The API Guidelines are also summarized in U.S. Pat. No. 7,285,516 B2 (see column 11, line 64 to column 12, line 10).

In certain embodiments, the oil of lubricating viscosity may be an API Group I, Group II, Group III, or Group IV mineral oil, an ester or other synthetic oil, or any mixtures thereof.

The amount of the oil of lubricating viscosity present in the lubricating compositions described herein, is generally the balance remaining after subtracting from 100 weight percent the sum of the amount of the dispersant additive package according to the present disclosure and additional additives, if any. As such, the amount of the oil of lubricating viscosity may vary widely among different embodiments, as it is dependent on the amounts of any other ingredients present in the lubricating composition. In certain embodiments, the oil of lubricating viscosity may represent a major portion of the lubricating composition. For example, the amount of the oil of lubricating viscosity present may be from 75 to 95 weight percent, such as from 80 to 95 weight percent, or from 80 to 90 weight percent, based on the total weight of the lubricating composition.

In certain embodiments, the oil of lubricating viscosity may have a kinematic viscosity measured at 100° C. of 2.4 $m^2/s$ to 6.4 $m^2/s$ according to standard test method ASTM D 445. In certain embodiments, the kinematic viscosity is from 4.0 $m^2/s$ to 5.0 $m^2/s$ or from 5.2 $m^2/s$ to 5.8 $m^2/s$ or from 6.0 $m^2/s$ to 6.5 $m^2/s$. In certain embodiments, the kinematic viscosity is 6.2 $m^2/s$, 5.6 $m^2/s$, or 4.6 $m^2/s$.

The lubricating compositions described herein may be in the form of a concentrate and/or a fully formulated lubricant. If the lubricating composition is in the form of a concentrate (which may be combined with additional oil to form, in whole or in part, a finished lubricant), the ratio of the components disclosed herein to the oil of lubricating viscosity and/or to diluent oil include the ranges of 1:99 to 99:1 by weight, or 80:20 to 10:90 by weight.

The ashless antioxidants described herein comprise benzazepine compounds and/or compounds derived from benzazepine. Benzazepine compounds are heterocyclic compounds containing a benzene ring fused to an azepine ring. Benzazepine compounds may be further substituted with hydrocarbyl groups, including dibenzazepine compounds comprising a second aromatic ring fused to the azepine ring. Benzazepine compounds may also be selected such that the azepine ring may be unsaturated, or fully or partially saturated. In certain embodiments, the azepine ring may further contain a heteroatom, such as oxygen, sulfur, and/or nitrogen. As used herein, the term "benzazepine compound" is intended to mean any of the compounds described in this paragraph.

In certain embodiments, the benzazepine compound is represented by at least one of the following general formulae IA or IB:

IA

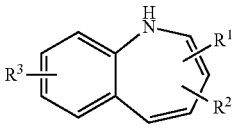

IB

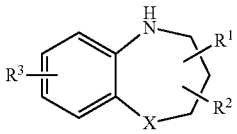

wherein, with respect to general formulae IA and IB: $R^1$, $R^2$ and $R^3$ are each independently hydrogen or a hydrocarbyl group of 1 to 24 carbon atoms, or $R^1$ and $R^2$ together form a saturated five- or six-membered carbon ring, an unsaturated five- or six-membered carbon ring, or an aromatic ring, any of which is optionally further substituted with a hydrocarbyl group of 1 to 24 carbon atoms; each X is independently O, S, or $NR^4$; and $R^4$ is hydrogen or a hydrocarbyl group of 1 to 18 carbon atoms.

In certain embodiments, the benzazepine compound may be a dibenzazepine compound, wherein the dibenzazepine compound is optionally represented by the at least one of the following general formulae IIA or IIB:

IIA

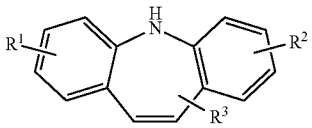

IIB

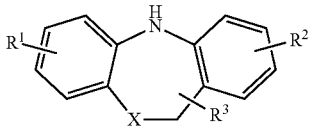

wherein, with respect to the general formulae IIA and IIB: $R^1$, $R^2$ and $R^3$ are each independently hydrogen or a hydrocarbyl group of 1 to 24 carbon atoms; each X is independently O, S, or $NR^4$; and $R^4$ is hydrogen or a hydrocarbyl group of 1 to 18 carbon atoms.

The ashless antioxidant may be present in the lubricating compositions described herein in an amount of from 0.1 to 5.0 weight percent, such as from 0.5 to 3.0 weight percent, or from 0.8 to 2.5 weight percent, or from 0.5 to 1.5 weight percent, based on the total weight of the lubricating composition.

In addition to the ashless antioxidant comprising a benzazepine compound described above, the lubricating compositions described herein may further comprise one or more of a polyisobutenyl succinimide dispersant, an overbased detergent, a neutral detergent, an antioxidant different from that of the ashless antioxidant described herein, an anti-wear agent, a friction modifier, a corrosion inhibitor, a polymeric viscosity modifier, and/or a foam inhibitor. In certain embodiments, fully formulated lubricating oils may contain one or more of these additives, and often a package of multiple such additives.

The lubricating compositions described herein may further comprise a dispersant. In certain embodiments, the dispersant may be a polyalkenyl succinimide dispersant. Dispersants, generally, are well known in the field of lubricants and generally include what are known as ashless dispersants and polymeric dispersants. Ashless dispersants are referred to as "ashless" because, as supplied, they do not contain metal and thus do not normally contribute to sulfated ash when added to a lubricant. However, they may interact with ambient metals once they are added to a lubricant which includes a metal-containing species. Ashless dispersants may be characterized by a polar group attached to a relatively high molecular weight hydrocarbon chain. Suitable ashless dispersants include N-substituted long chain alkenyl succinimides, having a variety of chemical structures, including those represented by the following general formula III:

III

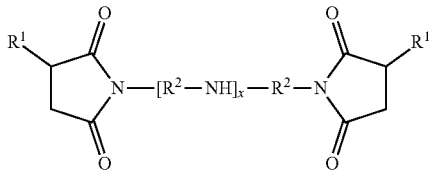

wherein, with respect to the general formula III: each $R^1$ is independently an alkyl group, such as a polyisobutylene group with a molecular weight ($M_n$) of 500-5000 g/mole based on the polyisobutylene precursor, and each $R^2$ is independently an alkylene group, such as an ethylene ($C_2H_4$) group.

Such molecules may be derived from reaction of an alkenyl acylating agent with a polyamine, and a wide variety of linkages between the two moieties is possible aside from the simple imide structure shown above, including a variety of amides and quaternary ammonium salts. In the above general formula, the amine portion is shown as an alkylene polyamine, although other aliphatic and aromatic mono- and polyamines may also be used. Also, a variety of modes of linkage of the $R^1$ groups of general formula III onto the imide structure are possible, including various cyclic linkages. The ratio of the carbonyl groups of the acylating agent to the nitrogen atoms of the amine may be 1:0.5 to 1:3, and in other instances 1:1 to 1:2.75, or 1:1.5 to 1:2.5. Succinimide dispersants are more fully described in U.S. Pat. Nos. 4,234,435, 3,172,892, and EP 0 355 895 A2/B1.

In certain embodiments, the dispersant is prepared by a process that involves the presence of small amounts of chlorine or other halogen, as described in U.S. Pat. No. 7,615,521 B2 (see, e.g., col. 4, lines 18-60 and preparative example A). Such dispersants typically have some carbocyclic structures in the attachment of the hydrocarbyl substituent to the acidic or amidic "head" group. In other embodiments, the dispersant is prepared by a thermal process involving an "ene" reaction, without the use of any chlorine or other halogen, as described in U.S. Pat. No. 7,615,521 B2; dispersants made in this manner are often derived from high vinylidene (i.e., greater than 50% terminal vinylidene) polyisobutylene (see col. 4, line 61 to col. 5, line 30 and preparative example B). Such dispersants typically do not contain the above-described carbocyclic structures at the point of attachment. In certain embodiments, the dispersant is prepared by free radical catalyzed polymerization of high-vinylidene polyisobutylene with an ethylenically unsaturated acylating agent, as described in U.S. Pat. No. 8,067,347 B2.

Some dispersants for use in the instant lubricating compositions may be derived from, as the polyolefin, high vinylidene polyisobutylene, that is, having greater than 50, 70, or 75% terminal vinylidene groups (a and R isomers). In certain embodiments, the succinimide dispersant may be prepared by the direct alkylation route. In other embodiments it may comprise a mixture of direct alkylation and chlorine-route dispersants.

Suitable dispersants for use in the lubricating compositions described herein include succinimide dispersants. In certain embodiments, the dispersant may be present as a single dispersant. In certain embodiments, the dispersant may be present as a mixture of two or three different dispersants, wherein at least one may optionally be a succinimide dispersant.

The succinimide dispersant may be at least one imide of an aliphatic polyamine of two to eight nitrogen atoms. The aliphatic polyamine may be an ethylenepolyamine, a propylenepolyamine, a butylenepolyamine, or mixtures thereof. In certain embodiments, the aliphatic polyamine may be ethylenepolyamine. In certain embodiments, the aliphatic polyamine may be ethylenediamine, diethylenetriamine, triethylenetetramine, tetraethylenepentamine, pentaethylenehexamine, polyamine still bottoms, or mixtures thereof.

The succinimide dispersant may be a derivative of an aromatic amine, an aromatic polyamine, or mixtures thereof. The aromatic amine may be 4-aminodiphenylamine (ADPA) (also known as N-phenylphenylenediamine), derivatives of ADPA (as described in US 2011/0306528 A1 and US 2010/0298185 A1), a nitroaniline, an aminocarbazole, an amino-indazolinone, an aminopyrimidine, 4-(4-nitrophenylazo)aniline, or combinations thereof. In certain embodiments, the dispersant is a derivative of an aromatic amine wherein the aromatic amine has at least three non-continuous aromatic rings.

The succinimide dispersant may be a derivative of a polyether amine, a polyether polyamine, or mixtures thereof. Typical polyether amine compounds contain at least one ether unit and will be chain terminated with at least one amine moiety. The polyether polyamines can be based on polymers derived from $C_2$-$C_6$ epoxides such as ethylene oxide, propylene oxide, and butylene oxide. Examples of polyether polyamines are sold under the Jeffamine® brand and are commercially available from Huntsman Corporation.

The dispersant may also be post-treated by conventional methods, such as by reaction with any of a variety of agents. Among these agents are boron compounds, urea, thiourea, dimercaptothiadiazoles, carbon disulfide, aldehydes, ketones, carboxylic acids, hydrocarbon-substituted succinic anhydrides, maleic anhydride, nitriles, epoxides, and phosphorus compounds. In certain embodiments, the succinimide dispersant may be post-treated with boron, resulting in a borated dispersant. In certain embodiments, the succinimide dispersant comprises at least one boron-containing dispersant and at least one boron-free dispersant. In certain embodiment, the lubricating composition is free of or substantially free of a boron-containing succinimide dispersant.

The polyalkenyl succinimide dispersant may be present in an amount of from 1.2 to 4 weight percent, based on the total weight of the lubricating composition, or from 1.5 to 3.8 weight percent, based on the total weight of the lubricating composition, or from 0.5 to 4.0 weight percent, based on the total weight of the lubricating composition, or from 0.8 to 3.0 weight percent, based on the total weight of the lubricating composition, or from 1.1 to 2.3 weight percent, based on the total weight of the lubricating composition, or from 1.5 to 2.8 weight percent, based on the total weight of the lubricating composition, or from 1.2 to 3 weight percent, based on the total weight of the lubricating composition, or from 2.0 to 3.5 weight percent, based on the total weight of the lubricating composition. If a mixture of two or more dispersants comprise the succinimide dispersant, each of those dispersants may be independently present in the composition at from 0.01 to 4 weight percent, or from 0.1 to 3.5 weight percent, or from 0.5 to 3.5 weight percent, or from 1.0 to 3.0 weight percent, or from 0.5 to 2.2 weight percent, based on the total weight of the lubricating composition, with the proviso that the total amount of dispersant is as described above. In certain embodiments, the polyalkenyl succinimide dispersant is a polyisobutylene succinimide. In certain embodiments, the polyalkenyl succinimide dispersant is a polyisobutylene succinimide and is present in the lubricating composition in an amount of from 1.2 to 4 weight percent, based on the total weight of the lubricating composition.

In certain embodiments, the polyalkenyl succinimide dispersant described above is a boron-containing succinimide dispersant in an amount of from 1.2 to 4 weight percent, based on the total weight of the lubricating composition, or in treat rates described above with regard to the polyalkenyl succinimide dispersant. In another embodiment, the polyalkenyl succinimide dispersant is a mixture of boron-free and boron-containing succinimide dispersants. When both boron-containing dispersants and boron-free dispersants are present, the ratio of the one or more boron-containing dispersants to the one or more boron-free dispersants may be 4:1 to 1:4 on a weight basis, or 3:1 to 1:3, or 2:1 to 1:3, or 1:1 to 1:4 on a weight basis. In certain embodiments, one or more boron-containing dispersants is present in an amount of from 0.8 to 2.1 weight percent and one or more boron-free dispersants is present in an amount of from 0.8 to 4 weight percent, based on the total weight of the lubricating composition.

In certain embodiments, the lubricating compositions described herein may include a metal-containing detergent. The metal-containing detergent may be an overbased detergent. Overbased detergents, sometimes referred to as overbased or superbased salts, are characterized by a metal content in excess of that which would be necessary for neutralization according to the stoichiometry of the metal and the particular acidic organic compound reacted with the metal. The overbased detergent may comprise non-sulfur containing phenates, sulfur containing phenates, sulfonates, salixarates, salicylates, and/or mixtures thereof.

The overbased detergent may comprise sodium salts, calcium salts, magnesium salts, and/or mixtures thereof, of the phenates, sulfur-containing phenates, sulfonates, salixarates, and/or salicylates. Overbased phenates and salicylates typically have a total base number of from 180 to 450 TBN. Overbased sulfonates typically have a total base number of from 250 to 600, or from 300 to 500. Overbased detergents are known in the art. In certain embodiments, the sulfonate detergent may be predominantly a linear alkylbenzene sulfonate detergent having a metal ratio of at least 8, as described in paragraphs to of US 2005/0065045 A1. The linear alkylbenzene sulfonate detergent may be particularly useful for assisting in improving fuel economy. The linear alkyl group may be attached to the benzene ring anywhere along the linear chain of the alkyl group, but often in the 2, 3 or 4 position of the linear chain, and in some instances, predominantly in the 2 position, resulting in the linear alkylbenzene sulfonate detergent. The overbased detergent may be present at from 0 to 15 weight percent, or from greater than 0 to 15 weight percent, or from 0.2 to 15 weight percent, or from 0.3 to 10 weight percent, or from 0.3 to 8 weight percent, or from 0.4 to 3 weight percent, or from 0.2 to 3 weight percent, based on the total weight of the lubricating composition. For example, in a heavy-duty diesel engine, the detergent may be present at from 2 to 3 weight percent, based on the total weight of the lubricating composition. For example, in a passenger car engine, the detergent may be present at from 0.2 to 1 weight percent, based on the total weight of the lubricating composition.

Metal-containing detergents contribute sulfated ash to a lubricating composition. Sulfated ash may be determined by ASTM D874. In certain embodiments, the lubricating composition described herein may comprise a metal-containing detergent in an amount to deliver at least 0.4 weight percent sulfated ash to the total lubricating composition. In another embodiment, the metal-containing detergent is present in an amount to deliver at least 0.6 weight percent sulfated ash, or at least 0.75 weight percent sulfated ash, or at least 0.9 weigh percent sulfated ash to the total lubricating composition.

In certain embodiments, the lubricating compositions described herein may further comprise an anti-wear agent. Examples of anti-wear agents include phosphorus-containing anti-wear/extreme pressure agents (such as metal thiophosphates), phosphoric acid esters and salts thereof, phosphorus-containing carboxylic acids, phosphorus-containing esters, phosphorus-containing ethers, phosphorus-containing amides, and phosphites. In certain embodiments, a phosphorus anti-wear agent may be present in an amount to deliver from 0.01 to 0.2 weight percent, or from 0.015 to 0.15 weight percent, or from 0.02 to 0.1 weight percent, or from 0.025 to 0.08 weight percent, or from 0.01 to 0.05 weight percent phosphorus to the total lubricating composition. In certain embodiments, the anti-wear agent is a zinc dialkyldithiophosphate.

Zinc dialkyldithiophosphates may be described as primary zinc dialkyldithiophosphates or as secondary zinc dialkyldithiophosphates, depending on the structure of the alcohol used in its preparation. In certain embodiments, the lubricating compositions described herein may comprise primary zinc dialkyldithiophosphates. In certain embodiments, the lubricating compositions described herein may comprise secondary zinc dialkyldithiophosphates. In certain embodiments, the lubricating compositions described herein may comprise a mixture of primary and secondary zinc dialkyldithiophosphates, optionally wherein the ratio of primary zinc dialkyldithiophosphates to secondary zinc dialkyldithiophosphates (one a weight basis) is at least 1:1, or at least 1:1.2, or at least 1:1.5, or at least 1:2, or at least 1:10. In certain embodiments, the lubricating compositions described herein may comprise a mixture of primary and secondary zinc dialkyldithiophosphates which is at least 50 (such as at least 60, at least 70, at least 80, or at least 90) percent by weight primary zinc dialkyldithiophosphate. In certain embodiments, the lubricating compositions described herein are substantially free of primary zinc dialkyldithiophosphates, or free of primary zinc dialkyldithiophosphates.

The phosphorus anti-wear agent may be present at from 0.05 to 3 weight percent, or from 0.08 to 1.3 weight percent, or from 0.08 to 2.1 weight percent, or from 0.1 to 1.5 weight percent, or from 0.5 to 0.9 weight percent, based on the total weight of the lubricating composition.

In certain embodiments, the lubricating compositions described herein may comprise an additional antioxidant different from the ashless antioxidant comprising a benzazepine compound described above. Such additional antioxidants (which may also be ashless antioxidants) may comprise one or more of arylamines, diarylamines, alkylated arylamines, alkylated diaryl amines, phenols, hindered phenols, or sulfurized olefins. Such additional antioxidants may be present at from 0.01 to 5 weight percent, or from 0.1 to 4 weight percent, or from 0.2 to 3 weight percent, or from 0.5 to 2 weight percent, based on the total weight of the lubricating composition.

The diarylamine or alkylated diarylamine may be a phenyl-α-naphthylamine (PANA), an alkylated diphenylamine, an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine, or mixtures thereof. In certain embodiments, the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine and/or dinonyl diphenylamine. The alkylated diarylamine may include octyl, di-octyl, nonyl, di-nonyl, decyl, or di-decyl phenylnapthylamines.

The diarylamine antioxidant may be present in the lubrication composition at from 0.1 to 10 weight percent, or from 0.35 to 5 weight percent, or from 0.4 to 1.2 weight percent, or from 0.5 to 2 weight percent, based on the total weight of the lubricating composition. In certain embodiments, the lubricating composition may contains less than 0.2 weight percent, or less than 0.1 weight percent, or less than 0.05 weight percent of a diarylamine antioxidant, based on the total weight of the lubricating composition; in one embodiment, the lubricating composition is free of or substantially free of a diarylamine antioxidant.

The phenolic antioxidant may be a simple alkyl phenol, a hindered phenol, and/or coupled phenolic compounds.

The hindered phenol antioxidant may contain a secondary butyl and/or a tertiary butyl group as a sterically hindering group. The phenol group may be further substituted with a hydrocarbyl group (such as linear or branched alkyl) and/or a bridging group linking to a second aromatic group. Examples of suitable hindered phenol antioxidants include 2,6-di-tert-butyl phenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol, 4-dodecyl-2,6-di-tert-butylphenol, or butyl 3-(3,5-ditert-butyl-4-hydroxyphenyl)propanoate. In certain embodiments, the hindered phenol antioxidant may be an ester and may include, e.g., Irganox™ L-135 from BASF. In certain embodiments, the phenolic antioxidant comprises a hindered phenol. In certain embodiments, the hindered phenol is derived from 2,6-di-tert-butyl phenol.

In certain embodiments, the lubricating compositions described herein may comprise a phenolic antioxidant in a range of from 0.01 to 5 weight percent, or from 0.1 to 4 weight percent, or from 0.2 to 3 weight percent, or from 0.5 to 2 weight percent, based on the total weight of the lubricating composition.

Sulfurized olefins are well-known commercial materials, and those which are substantially nitrogen-free, that is, not containing nitrogen functionality, are readily available. The olefinic compounds which may be sulfurized are diverse in nature. They contain at least one olefinic double bond, which is defined as a non-aromatic double bond; that is, one connecting two aliphatic carbon atoms. These materials generally have sulfide linkages having 1 to 10 sulfur atoms, for instance, 1 to 4, or 1, or 2.

The additional (such as ashless) antioxidants described above may be used separately or in combination. In certain embodiments, two or more different additional antioxidants may be used in combination, such that there is at least 0.1 weight percent of each of the at least two antioxidants, and optionally wherein the combined amount of the additional antioxidants is 0.5 to 5 weight percent, based on the total weight of the lubricating composition.

In certain embodiments, there may be from 0.25 to 3 weight of each additional antioxidant, based on the total weight of the lubricating composition.

In certain embodiments, the lubricating compositions described herein may comprise a molybdenum compound. The molybdenum compound may be molybdenum dialkyldithiophosphates, molybdenum dithiocarbamates, amine salts of molybdenum compounds, or mixtures thereof. The molybdenum compound may provide the lubricating composition with from 0 to 1000 ppm, or from 5 to 1000 ppm, or from 10 to 750 ppm, or from 5 to 300 ppm, or from 20 to 250 ppm, or from 350 to 900 ppm molybdenum, based on the total lubricating composition.

The lubricating compositions described herein may further comprise a polymeric viscosity modifier. It is known that polymeric viscosity modifiers may be functionalized or derivatized; functionalized polymeric viscosity modifiers are also called dispersant viscosity modifiers (DVM). The polymeric viscosity modifiers may be olefin (co)polymers, poly(meth)acrylate (PMA), or mixtures thereof. In certain embodiments, the polymeric viscosity modifier is an olefin (co)polymer.

The olefin polymer may be derived from isobutylene or isoprene. In certain embodiments, the olefin polymer is prepared from ethylene and a higher olefin within the range of $C_3$-$C_{10}$ alpha-mono-olefins; for example, the olefin polymer may be prepared from ethylene and propylene.

In certain embodiments, the olefin polymer may be a polymer of from 15 to 80 (such as from 30 to 70) mole percent ethylene, and from 20 to 85 (such as from 30 to 70) mole percent $C_3$ to $C_{10}$ mono-olefins, such as propylene. Terpolymer variations of the olefin copolymer may also be used and may contain up to 15 mol percent of a non-conjugated diene or triene. Non-conjugated dienes or trienes may have 5 to 14 carbon atoms. The non-conjugated diene or triene monomers may be characterized by the presence of a vinyl group in the structure and can include cyclic and bicycle compounds. Representative dienes include 1,4-hexadiene, 1,4-cyclohexadiene, dicyclopentadiene, 5-ethyldiene-2-norbornene, 5-methylene-2-norbornene, 1,5-heptadiene, and 1,6-octadiene.

In certain embodiments, the olefin copolymer may be a copolymer of ethylene, propylene, and butylene. The polymer may be prepared by polymerizing a mixture of monomers comprising ethylene, propylene, and butylene. These polymers may be referred to as copolymers or terpolymers. The terpolymer may comprise from 5 to 20 mole percent, or from 5 to 10 mole percent, structural units derived from ethylene; from 60 to 90 mole percent, or from 60 mole percent to 75 mole percent, structural units derived from propylene; and from 5 to 30 mole percent, or from 15 to 30 mole percent, structural units derived from butylene. The butylene may comprise any isomers or mixtures thereof, such as n-butylene, iso-butylene, or a mixture thereof. The butylene may comprise butene-1. Commercial sources of butylene may comprise butene-1 as well as butene-2 and butadiene. The butylene may comprise a mixture of butene-1 and isobutylene wherein the weight ratio of butene-1 to isobutylene is about 1:0.1 or less. The butylene may comprise butene-1 and be free of or substantially free of isobutylene.

In certain embodiments, the olefin copolymer may be a copolymer of ethylene and butylene. The polymer may be prepared by polymerizing a mixture of monomers comprising ethylene and butylene, wherein the monomer composition is free of or substantially free of propylene monomers (i.e., contains less than 1 weight percent of intentionally added propylene monomer). The copolymer may comprise from 30 to 50 mole percent structural units derived from butylene; and from 50 to 70 mole percent structural units derived from ethylene. The butylene may comprise a mixture of butene-1 and isobutylene wherein the weight ratio of butene-1 to isobutylene is about 1:0.1 or less. The butylene may comprise butene-1 and be free of or substantially free of isobutylene.

Useful olefin polymers, such as ethylene-α-olefin copolymers, have a number average molecular weight ranging from 4,500 to 500,000 g/mole, for example, 5,000 to 100,000 g/mole, or 7,500 to 60,000 g/mole, or 8,000 to 45,000 g/mole.

In certain embodiments, the lubricating compositions described herein may comprise a poly(meth)acrylate polymeric viscosity modifier. As used herein, the term "(meth) acrylate" and its cognates means methacrylate and/or acrylate.

In certain embodiments, the poly(meth)acrylate polymer is prepared from a monomer mixture comprising (meth) acrylate monomers having alkyl groups of varying length. The (meth)acrylate monomers may contain alkyl groups that are straight chain or branched chain groups. The alkyl groups may contain 1 to 24 carbon atoms, for example 1 to 20 carbon atoms.

The poly(meth)acrylate polymers may be formed from monomers derived from saturated alcohols, such as methyl (meth)acrylate, ethyl (meth)acrylate, propyl (meth)acrylate, butyl (meth)acrylate, 2-methylpentyl (meth)acrylate, 2-propylheptyl (meth)acrylate, 2-butyloctyl (meth)acrylate, 2-ethylhexyl (meth)acrylate, octyl (meth)acrylate, nonyl (meth)acrylate, isooctyl (meth)acrylate, isononyl (meth) acrylate, 2-tert-butylheptyl (meth)acrylate, 3-isopropylheptyl (meth)acrylate, decyl (meth)acrylate, undecyl (meth) acrylate, 5-methylundecyl (meth)acrylate, dodecyl (meth) acrylate, 2-methyldodecyl (meth)acrylate, tridecyl (meth) acrylate, 5-methyltridecyl (meth)acrylate, tetradecyl (meth) acrylate, pentadecyl (meth)acrylate, hexadecyl (meth) acrylate, 2-methylhexadecyl (meth)acrylate, heptadecyl (meth)acrylate, 5-isopropylheptadecyl (meth)acrylate, 4-tert-butyl octadecyl (meth)acrylate, 5-ethyl octadecyl (meth)acrylate, 3-isopropyloctadecyl (meth)acrylate, octadecyl (meth)acrylate, nonadecyl (meth)acrylate, eicosyl (meth)-acrylate, (meth)acrylates derived from unsaturated alcohols (such as oleyl (meth)acrylate), and/or cycloalkyl (meth)acrylates (such as 3-vinyl-2-butylcyclohexyl (meth) acrylate or bornyl (meth)acrylate).

Other examples of monomers include alkyl (meth)acrylates with long-chain alcohol-derived groups which may be obtained, for example, by reaction of a (meth)acrylic acid (by direct esterification) or methyl (meth)acrylate (by transesterification) with long-chain fatty alcohols, in which reaction a mixture of esters such as (meth)acrylate with alcohol groups of various chain lengths is generally obtained. These fatty alcohols include Oxo Alcohol® 7911, Oxo Alcohol® 7900 and Oxo Alcohol® 1100 from Monsanto; Alphanol® 79 from ICI; Nafol® 1620, Alfol® 610 and Alfol® 810 from Sasol; Epal® 610 and Epal® 810 from Ethyl Corporation; Linevol® 79, Linevol® 911 and Dobanol® 25 L from Shell AG; Lial® 125 from Condea Augusta, Milan; Dehydad® and Lorol® from Cognis, and Linopol® 7-11 and Acropol® 91 from Ugine Kuhlmann.

In certain embodiments, the poly(meth)acrylate polymer comprises a dispersant monomer; dispersant monomers include those monomers which may copolymerize with (meth)acrylate monomers and contain one or more heteroatoms in addition to the carbonyl group of the (meth)acrylate. The dispersant monomer may contain a nitrogen-containing group, an oxygen-containing group, or mixtures thereof.

The nitrogen-containing compound may be a (meth) acrylamide or a nitrogen containing (meth)acrylate monomer. Examples of a suitable nitrogen-containing compounds include N,N-dimethylacrylamide, N-vinyl carbonamides (such as N-vinyl-formamide), vinyl pyridine, N-vinylacetoamide, N-vinyl propionamides, N-vinyl hydroxy-acetoamide, N-vinyl imidazole, N-vinyl pyrrolidinone, N-vinyl caprolactam, dimethylaminoethyl acrylate (DMAEA), dimethylaminoethyl methacrylate (DMAEMA), dimethylaminobutyl acrylamide, dimethylaminopropyl meth-acrylate (DMAPMA), dimethylaminopropyl acrylamide, dimethylaminopropyl methacrylamide, dimethylaminoethyl acrylamide, or mixtures thereof.

Dispersant monomers may be present in an amount up to 5 mole percent of the monomer composition of the (meth) acrylate polymer. In one embodiment, the poly(meth)acrylate is present in an amount 0 to 5 mol percent, or 0.5 to 4 mole percent, or 0.8 to 3 mol percent, of the polymer composition. In certain embodiments, the poly(meth)acrylate is free of or substantially free of dispersant monomers.

In certain embodiments, the poly(meth)acrylate comprises a block copolymer or tapered block copolymer. Block copolymers are formed from a monomer mixture comprising one or more (meth)acrylate monomers, wherein, for example, a first (meth)acrylate monomer forms a discrete block of the polymer joined to a second discrete block of the polymer formed from a second (meth)acrylate monomer. While block copolymers have substantially discrete blocks formed from the monomers in the monomer mixture, a tapered block copolymer may be composed of, at one end, a relatively pure first monomer and, at the other end, a relatively pure second monomer, while the middle of the tapered block copolymer is more of a gradient composition of the two monomers.

In certain embodiments, the poly(meth)acrylate polymer (P) may be a block or tapered block copolymer that comprises at least one polymer block (B1) that is insoluble or substantially insoluble in the base oil and a second polymer block (B2) that is soluble or substantially soluble in the base oil.

In certain embodiments, the poly(meth)acrylate polymers may have an architecture selected from linear, branched, hyper-branched, cross-linked, star (also referred to as "radial"), or combinations thereof. Star or radial refers to multi-armed polymers. Such polymers include (meth)acrylate-containing polymers comprising three or more arms or branches, which, in some embodiments, may contain at least 20 (such as at least 50, 100, 200, 350, 500, or 1000) carbon atoms. The arms are generally attached to a multivalent organic moiety which acts as a "core" or "coupling agent." The multi-armed polymer may be referred to as a radial or star polymer, or even a "comb" polymer, or a polymer otherwise having multiple arms or branches as described herein.

Linear poly(meth)acrylates, random, block or otherwise, may have weight average molecular weight (Mw) of from 1000 to 400,000 Daltons, from 1000 to 150,000 Daltons, or from 15,000 to 100,000 Daltons. In certain embodiments, the poly(meth)acrylate may be a linear block copolymer with a Mw of from 5,000 to 40,000 Daltons, or from 10,000 to 30,000 Daltons.

Radial, cross-linked or star copolymers may be derived from linear random or di-block copolymers with molecular weights as described above. A star polymer may have a weight average molecular weight of from 10,000 to 1,500,000 Daltons, or from 40,000 to 1,000,000 Daltons, or from 300,000 to 850,000 Daltons.

The lubricating compositions described herein may comprise from 0.05 to 2 weight percent, or from 0.08 to 1.8 weight percent, or from 0.1 to 1.2 weight percent, of the one or more polymeric viscosity modifiers as described herein, based on the total weight of the lubricating composition.

In certain embodiments, the polymeric viscosity modifier may include a DVM. The DVM may be present at from 0 to 5 weight percent, or from 0 to 4 weight percent, or from greater than 0 to 5 weight percent, or from greater than 0 to 4 weight percent, or from 0.05 to 2 weight percent, based on the total weight of the lubricating composition.

Suitable DVMs include: functionalized polyolefins, for example, ethylene-propylene copolymers that have been functionalized with an acylating agent such as maleic anhydride and an amine; polymethacrylates functionalized with an amine; or esterified styrene-maleic anhydride copolymers reacted with an amine. Descriptions of DVMs are provided in WO 2006/015130 A1, or U.S. Pat. Nos. 4,863,623, 6,107,257, 6,107,258, and 6,117,825. In certain embodiments, the DVM may include those described in U.S. Pat. No. 4,863,623 (see column 2, line 15 to column 3, line 52) or in WO 2006/015130 A1 (see page 2, paragraph and preparative examples are described at paragraphs [0065] to [0073]).

Suitable amines for formation of DVMs include aliphatic amines, aliphatic polyamines, aromatic amines, aromatic polyamines, polyether compounds, polyetheramines (such as those described above), and combinations thereof. The aliphatic polyamine may be an ethylenepolyamine, a propylenepolyamine, a butylenepolyamine, or mixtures thereof. In certain embodiments, the aliphatic polyamine may be ethylenepolyamine. In certain embodiments the aliphatic polyamine may be ethylenediamine, diethylenetriamine, triethylenetetramine, tetraethylenepentamine, pentaethylenehexamine, polyamine still bottoms, or mixtures thereof.

The aromatic amine may be 4-aminodiphenylamine (ADPA) (also known as N-phenylphenylenediamine), derivatives of ADPA (as described in US 2011/0306528 A1 and US 2010/0298185 A1), a nitroaniline, an aminocarbazole, an amino-indazolinone, an aminopyrimidine, 4-(4-nitrophenylazo)aniline, or combinations thereof. In certain embodiments, the DVM may be a derivative of an aromatic amine, optionally wherein the aromatic amine has at least three non-continuous aromatic rings.

The DVM may be a derivative of a polyether amine or polyether polyamine. Suitable polyether amine compounds may contain at least one ether unit and may be chain terminated with at least one amine moiety. The polyether polyamines can be based on polymers derived from $C_2$-$C_6$ epoxides such as ethylene oxide, propylene oxide, and butylene oxide. Examples of commercially-available polyether polyamines are sold under the Jeffamine® brand and are commercially available from Huntsman Corporation.

In certain embodiments, the lubricating compositions described herein may further comprise a friction modifier. Examples of suitable friction modifiers include long chain fatty acid derivatives of amines, fatty esters, or epoxides; fatty imidazolines, such as condensation products of carboxylic acids and polyalkylene-polyamines; amine salts of alkylphosphoric acids; fatty alkyl tartrates; fatty alkyl tartrimides; and/or fatty alkyl tartramides. The term fatty, as used herein, may mean having a $C_8$-$C_{22}$ linear alkyl group.

These friction modifiers may also encompass materials such as sulfurized fatty compounds and olefins, molybdenum dialkyldithiophosphates, molybdenum dithiocarbamates, sunflower oil, and/or a monoester of a polyol and an aliphatic carboxylic acid.

In certain embodiments, the friction modifier may comprise at least one of long chain fatty acid derivatives of amines, long chain fatty esters, or long chain fatty epoxides; fatty imidazolines; amine salts of alkylphosphoric acids; fatty alkyl tartrates; fatty alkyl tartrimides; or fatty alkyl tartramides.

In certain embodiments, the friction modifier may be a long chain fatty acid ester. In certain embodiments the long chain fatty acid ester may be a mono-ester, a diester, or a mixture thereof, and in certain embodiments the long chain fatty acid ester may be a triglyceride. In certain embodiments, the friction modifier may be glycerol mono-oleate.

The friction modifier may be present at from 0 to 6 weight percent, or from 0.05 to 4 weight percent, or from 0.1 to 2 weight percent, based on the total weight of the lubricating composition.

Other performance additives, such as corrosion inhibitors, include those described in WO 2006/047486 A1, octyl octanamide, condensation products of dodecenyl succinic acid or anhydride and a fatty acid (such as oleic acid) with a polyamine may be present in the lubricating compositions described herein. In certain embodiments, the corrosion inhibitors include Synalox® (a registered trademark of The Dow Chemical Company) corrosion inhibitors. Synalox® corrosion inhibitors may be a homopolymer or copolymer of propylene oxide. The Synalox®. corrosion inhibitors are described in more detail in a product brochure with Form No. 118-01453-0702 AMS, published by The Dow Chemical Company, entitled "SYNALOX Lubricants, High-Performance Polyglycols for Demanding Applications".

The lubricating compositions described herein may further comprise: metal deactivators, including derivatives of benzotriazoles (typically tolyltriazole), dimercaptothiadiazole derivatives, 1,2,4-triazoles, benzimidazoles, 2-alkyldithiobenzimidazoles, and/or 2-alkyldithiobenzothiazoles; foam inhibitors, including copolymers of ethyl acrylate and 2-ethylhexylacrylate, and/or copolymers of ethyl acrylate and 2-ethylhexylacrylate and vinyl acetate; demulsifiers, including trialkyl phosphates, polyethylene glycols, polyethylene oxides, polypropylene oxides, and/or (ethylene oxide/propylene oxide) polymers; and pour point depressants, including esters of maleic anhydride-styrene, polymethacrylates, polyacrylates, and/or polyacrylamides.

Suitable our point depressants may include polyalphaolefins, esters of maleic anhydride-styrene, poly(meth)acrylates, polyacrylates, and/or polyacrylamides.

In certain embodiments the lubricating compositions described herein may have a composition as described in the following table:

| | Embodiments (wt %) | | |
|---|---|---|---|
| Additive | A | B | C |
| Benzazepine Compound | 0.1 to 5.0 | 0.5 to 3.0 | 0.8 to 2.5 |
| Polyalkenyl Succinimide Dispersant | 1.2 to 8 | 1.5 to 5 | 2 to 3.4 |
| Anti-wear Agent(s) | 0.15 to 4 | 0.2 to 2 | 0.5 to 1.5 |
| Additional Ashless Antioxidant(s) | 0 to 6 | 0.6 to 3 | 0.8 to 2.5 |
| Metal Detergent(s) | 0 to 5 | 0.45 to 2.5 | 0.8 to 2 |
| Viscosity Modifier(s) | 0 or 0.1 to 4.5 | 0.5 to 3 | 0.8 to 1.8 |
| Dispersant Viscosity Modifier(s) | 0 or 0.1 to 4.5 | 0 or 0.1 to 2.5 | 0.5 to 1.6 |
| Friction Modifier(s) | 0 or 0.05 to 2 | 0.05 to 1.6 | 0.1 to 1.2 |
| Any Other Performance Additive(s) | 0 or 0.05 to 6 | 0 or 0.05 to 3 | 0 or 0.05 to 1.8 |
| Other Oil of Lubricating Viscosity | Balance to 100% | | |

The benzazepine compounds described herein may be used in lubricant compositions formulated to lubricate a mechanical device. Such mechanical devices include, without limitation, an internal combustion engine (such as, for example, a spark ignited internal combustion engine, or a compression ignition internal combustion engine), and a driveline device (such as an automatic transmission, manual transmission, dual clutch transmissions, or an axle or differential). The compression ignition internal combustion engine may include a heavy-duty diesel engine.

Diesel engines may be classified by their Gross Vehicle Weight Rating (GVWR). The GVWR includes the maximum rated weight of the vehicle and cargo, including passengers. The GVWR may be applied to trucks or trailers, but not the two combined, which is a separate rating referred to as the Gross Combined Weight Rating (GCWR). The GVWR's for various classes of diesel engines are set forth in the following table:

| Class | GVWR (lbs) |
|---|---|
| Class 1 | 0-6,000 lbs |
| Class 2A | 6,001-8,500 lbs |
| Class 2B | 8,501-10,000 lbs |
| Class 3 | 10,001-14,000 lbs |
| Class 4 | 14,001-16,000 lbs |
| Class 5 | 16,001-19,500 lbs |
| Class 6 | 19,5001-26,000 lbs |
| Class 7 | 26,001-33,000 lbs |
| Class 8 | Over 33,000 lbs |

Light duty vehicles are classified as those falling in Class 1 to 3. Class 2A vehicles are typically called "light duty" and class 2B vehicles are often called "light heavy duty" vehicles. Medium duty vehicles refer to those falling into Classes 4 to 6. Heavy-Duty vehicles are those classified in Class 7 and Class 8.

Lubricant compositions described herein having the disclosed ashless antioxidant comprising a benzazepine compound may be used in lubricants for diesel engines in all of Class 1 through Class 8 engines. In certain embodiments, the lubricant compositions are used in Class 8 engines.

EXAMPLES

The subject matter disclosed herein may be better understood with reference to the following examples, which are set forth merely to further illustrate the subject matter disclosed herein. The illustrative examples should not be construed as limiting the subject matter in any manner.

A series of benzazepine compounds were evaluated for their ability to reduce oxidative degradation of lubricating compositions. The procedure to alkylate commercially available selected benzazepine is described below, and examples of suitable (di)benzazepine compounds are summarized below (Table 1).

Example A (2,8-dinonyl-10,11-dihydro-5H-dibenzo[b,f]azepine): A 1 L, 4-neck flask was equipped with an overhead stirrer, nitrogen subsurface tube supplying 0.1 cfh $N_2$, and a Dean-Stark trap topped with a water condenser. To the flask was charged propylene trimer (182 g, 1.46 mol). The flask was heated to 85° C. and 10,11-dihydro-5h-dibenzo[b,f]azepine (95 g, 487 mmol) was then charged and slurried in the flask. The reaction was further heated to 100° C. and acidic clay (28.5 g) was then charged. The reaction was heated to reflux at 150° C. and held for 12 h. The reaction was filtered through diatomaceous earth and then stripped of residual olefin at 170° C. The reaction was again filtered to provide the product as a viscous yellow oil (91.1 g, 41.8%). % N~3.4%, TBN~125 mg KOH/g material.

Structure I

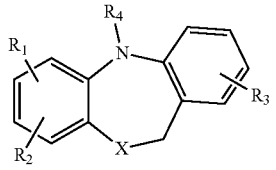

Structure II

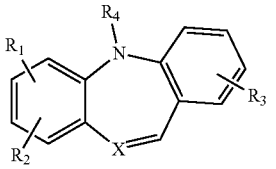

TABLE 1A

| Structure | Example | X | $R_1$ | $R_2$ | $R_3$ | $R_4$ |
|---|---|---|---|---|---|---|
| I | A | —$CH_2$— | —$C_9H_{19}$ (B) | —H | —$C_9H_{19}$ (B) | —H |
| II | B | —CH— | —$C_9H_{19}$ (B) | —H | —$C_9H_{19}$ (B) | —H |
| I | C | —$CH_2$— | —$C_{10}H_{21}$ (L) | —H | —$C_{10}H_{21}$ (L) | —H |
| I | D | —$CH_2$— | —$C_9H_{19}$ (B) | —H | —$C_9H_{19}$ (B) | —$CH_2CH{=}CH_2$ |
| I | E | —$CH_2$— | —$C_9H_{19}$ (B) | —$C_9H_{19}$ (B) | —$C_9H_{19}$ (B) | —H |
| I | F | —$CH_2$— | —$C_9H_{19}$ (B) | —H | —$C_9H_{19}$ (B) | —$CH_3$ |
| I | G | —$CH_2$— | —$C_{12}H_{25}$ (B) | —H | —$C_{12}H_{25}$ (B) | —H |
| II | H | —CH— | —$C_{12}H_{25}$ (B) | —H | —$C_{12}H_{25}$ (B) | —H |
| I | I | —NH— | —$C_9H_{19}$ (B) | —H | —$C_9H_{19}$ (B) | —H |
| I | J | —O— | —$C_9H_{19}$ (B) | —H | —$C_9H_{19}$ (B) | —H |
| II | K | —N— | —$C_9H_{19}$ (B) | —H | —$C_9H_{19}$ (B) | —H |

Example B (2,8-bis(4,6-dimethylheptan-2-yl)-5H-dibenzo[b,f]azepine): A 1 L, 4-neck flask was equipped with an overhead stirrer, $N_2$ line, thermowell, and a Friedrich condenser. 5H-dibenzo[b,f]azepine (100 g, 512 mmol) and acetic anhydride were charged into the flask and heated to 125° C. After 4 h, the volatiles were removed via vacuum stripping. Propylene trimer (196 g, 1.55 mol) was charged to the flask and the material was heated to 80° C. Aluminum trichloride was then charged and the reaction was heated to and held at 150° C. for 9 hours. The reaction was cooled to 80° C. and 10 g of water was slowly added followed by 170 g of 45% KOH solution (aq.). The mixture was heated and held at 110° C. for 7 hours then left to phase separate. The aqueous layer was drained and the organic layer was stripped to remove excess propylene trimer. Upon cooling the product solidified into a brown solid (113 g, 93%). % N~5.9%.

Tables 1A and 1B below present illustrative benzazepine compounds according to the present subject matter, made similarly to Example A/Example B above, in reference to one of the following Structure I or Structure II (in Table 1A, (B) refers to a branched hydrocarbyl group and (L) refers to a linear hydrocarbyl group):

TABLE 1B

| Structure | Example | IUPAC |
|---|---|---|
| I | A | 2,8-bis(4,6-dimethylheptan-2-yl)-10,11-dihydro-5H-dibenzo[b,f]azepine |
| II | B | 2,8-bis(4,6-dimethylheptan-2-yl)-5H-dibenzo[b,f]azepine |
| I | C | 2,8-di(nonan-2-yl)-10,11-dihydro-5H-dibenzo[b,f]azepine |
| I | D | 5-allyl-2,8-bis(4,6-dimethylheptan-2-yl)-10,11-dihydro-5H-dibenzo[b,f]azepine |
| I | E | 2,4,8-tris(4,6-dimethylheptan-2-yl)-10,11-dihydro-5H-dibenzo[b,f]azepine |
| I | F | 2,8-bis(4,6-dimethylheptan-2-yl)-5-methyl-10,11-dihydro-5H-dibenzo[b,f]azepine |
| I | G | 2,8-bis(4,6,8-trimethylnonan-2-yl)-10,11-dihydro-5H-dibenzo[b,f]azepine |
| II | H | 2,8-bis(4,6,8-trimethylnonan-2-yl)-5H-dibenzo[b,f]azepine |
| I | I | 2,8-bis(4,6-dimethylheptan-2-yl)-10,11-dihydro-5H-dibenzo[b,e][1,4]diazepine |
| I | J | 2,8-bis(4,6-dimethylheptan-2-yl)-5,11-dihydrodibenzo[b,e][1,4]oxazepine |
| II | K | 2,8-bis(4,6-dimethylheptan-2-yl)-5H-dibenzo[b,e][1,4]diazepine |

Lubricating compositions: A series of 5W-30 lubricant compositions were prepared with the various benzazepine compounds described herein as well as conventional crankcase additives such as ashless polyisobutenylsuccinimide dispersant, overbased alkaline earth metal detergent, zinc dialkyl dithiophosphate (ZDDP), additional ashless antioxidant, polymeric viscosity modifiers, and other common additives, as shown in Table 2.

TABLE 2[1]

| | EX1 | EX2 | EX3 | EX4 | EX5 | EX6 |
|---|---|---|---|---|---|---|
| Group III Base Oil | | | Balance to 100% | | | |
| Nonylated diphenylamine | 0 | 0.8 | 1.5 | 0 | 0 | 0 |
| Example A | 0 | 0 | 0 | 0.8 | 1.5 | 0 |
| Example B | 0 | 0 | 0 | 0 | 0 | 0.8 |
| PIBsuccinimide Dispersant[2] | 2.9 | 2.9 | 2.9 | 2.9 | 2.9 | 2.9 |
| Borated PIBsuccinimide Dispersant[3] | 2.85 | 2.85 | 2.85 | 2.85 | 2.85 | 2.85 |
| Magnesium Sulfonate[4] | 0.29 | 0.29 | 0.29 | 0.29 | 0.29 | 0.29 |
| Calcium Salicylate[5] | 1.1 | 1.1 | 1.1 | 1.1 | 1.1 | 1.1 |
| ZDDP - secondary C3/C6 | 0.73 | 0.73 | 0.73 | 0.73 | 0.73 | 0.73 |
| Sulfurized olefin | 0.5 | 0.5 | 0.5 | 0.5 | 0.5 | 0.5 |
| Oxyalkylated phenol | 2 | 2 | 2 | 2 | 2 | 2 |
| Styrene-diene VM | 0.54 | 0.54 | 0.54 | 0.54 | 0.54 | 0.54 |
| Other Additives[6] | 0.2 | 0.2 | 0.2 | 0.2 | 0.2 | 0.2 |
| Calcium (ppm) | 1180 | 1220 | 1220 | 1220 | 1220 | 1230* |
| Magnesium (ppm) | 460 | 490 | 480 | 480 | 480 | 470* |
| Phosphorus (ppm) | 740 | 830 | 835 | 840 | 860 | 800* |
| Sulfur (ppm) | 2270 | 2550 | 2580 | 2620 | 2680 | 2600* |
| Kinematic Viscosity (100° C.) | 9.73 | 9.80 | 9.84 | 9.81 | 9.89 | 9.8* |

*Calculated value

[1]All treat rates are oil free, unless otherwise indicated

[2]Polyisobutenyl succinimide made from high vinylidene PIB (TBN 26 mg KOH/g)

[3]Borated polyisobutenyl succinimide made from high vinylidene PIB (TBN 27 mg KOH/g; 0.8% B)

[4]Overbased magnesium alkylbenzene sulfonate (TBN 700 mg KOH/g)

[5]Overbased calcium alkylsalicylate (TBN 300 mg KOH/g)

[6]Other additives include pourpoint depressant and foam inhibitor

Oxidation resistance was evaluated by determining oxidation inhibition times using pressure differential scanning calorimetry (CEC L85), deposit formation with the Komatsu hot tube test (KHT), MHT TEOST (ASTM D7097), Microcoker test (MCT) and oxidative stability in the presence of biodiesel (according to ACEA 2016: CEC L109). Relative performance of azepine derivatives in tests were compared to antioxidant free and alkylated diphenylamine containing formulations, as shown in Table 3.

The MCT involves placing 0.6 mL of the lubricating composition in the trough of an aluminum-alloy plate heated at one end (hot spot) and regulated at the other end (cold spot). At the end of the test, the deposit formation is determined and rated on a scale of 1-10 according to the CEC M-02-A-78 Code of Practice. Higher ratings indicate better deposit performance.

KHT measures the deposit formation tendency of the lubricating composition at high temperature conditions. In KHT, high rating means better deposit control performance. The KHT test employs heated glass tubes through which a sample lubricating composition is pumped (5 mL total sample), at 0.31 mL/hour for 16 hours, with an air flow of 10 mL/minute. The glass tube is rated at the end of test for deposits on a scale of 0 (very heavy varnish) to 10 (no varnish).

Except in the Examples, or where otherwise explicitly indicated or required by context, all numerical quantities in this description specifying amounts of materials, reaction conditions, molecular weights, number of carbon atoms, and the like, are to be understood as modified by the word "about". As used herein, the term "about" means that a value of a given quantity is within ±20% of the stated value. In other embodiments, the value is within ±15% of the stated value. In other embodiments, the value is within ±10% of the stated value. In other embodiments, the value is within ±5% of the stated value. In other embodiments, the value is within ±2.5% of the stated value. In other embodiments, the value is within ±1% of the stated value. In other embodiments, the value is within a range of the explicitly-described value which would be understood by those of ordinary skill, based on the disclosures provided herein, to perform substantially similarly to compositions including the literal amounts described herein.

It is to be understood that the upper and lower amount, range, and ratio limits set forth herein may be independently combined, and that any amount within a disclosed range is contemplated to provide a minimum or maximum of a narrower range in alternative embodiments (with the proviso, of course, that the minimum amount of a range must be lower than the maximum amount of the same range). Similarly, the ranges and amounts for each element of the subject matter disclosed herein may be used together with ranges or amounts for any of the other elements.

TABLE 3

| | EX1 | EX2 | EX3 | EX4 | EX5 | EX6 |
|---|---|---|---|---|---|---|
| PDSC - Oxidation Induction Time (min) [CEC L85] | 41 | 119 | 174 | 119 | 161 | nd |
| Hot Tube Rating (@280° C.) | 0 | 7 | 7 | 7 | 7 | nd |
| L109 - Δ Oxidation @ 216 hr | 61 | 37 | 29 | 37 | 32 | nd |
| L109 - Δ KV100 @ 216 hr ($m^2/s$) | 151 | 41 | 32 | 67 | 59 | nd |
| MHT TEOST - Total Deposits (mg) | 42.3 | 22.2 | 11.5 | 23.6 | 13.5 | nd |
| MCT Panel (Merit) | 7.7 | 9 | 9.2 | 8.8 | 9.2 | nd |

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and components within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, or compositions, which can, of course, vary. It is also to be understood that the terminology used herein is for the purpose of describing particular embodiments only and is not intended to be limiting.

What is claimed is:

1. A lubricating composition comprising an oil of lubricating viscosity and a benzazepine compound, wherein the benzazepine compound comprises a dibenzazepine compound represented by at least one of the following general formulae IIA or IIB:

IIA

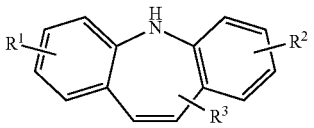

IIB

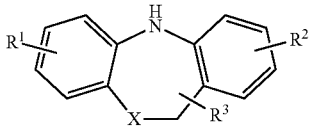

wherein $R^1$, $R^2$ and $R^3$ are each independently hydrogen or a hydrocarbyl group of 1 to 24 carbon atoms; each X is independently O, S, or $NR^4$; and $R^4$ is hydrogen or a hydrocarbyl group of 1 to 18 carbon atoms.

2. The lubricating composition of claim 1, wherein the benzazepine compound is present in the lubricating composition in an amount 0.1 to 5.0 weight percent based on the total weight of the lubricating composition.

3. The lubricating composition of claim 1, wherein the lubricating composition comprises at least 0.3 weight percent of at least one additional lubricant additive comprising at least one of an ashless polyisobutenyl succinimide dispersant, an overbased or neutral metal-based detergent, an anti-wear agent, a polymeric viscosity modifier, or an ashless antioxidant different from the benzazepine compound.

4. The lubricating composition of claim 3, wherein the ashless polyisobutenyl succinimide dispersant is present in the lubricating composition in an amount of from 0.5 to 4.0 weight percent based on the total weight of the lubricating composition.

5. The lubricating composition of claim 3, wherein the metal-based detergent comprises at least one of a neutral alkaline earth metal detergent or an overbased alkaline earth metal detergent, in an amount of from 0.2 to 15 weight percent based on the total weight of the lubricating composition.

6. The lubricating composition of claim 5, wherein the at least one of a neutral alkaline earth metal detergent or an overbased alkaline earth metal detergent comprises at least one of an alkylbenzene sulfonate detergent, a sulfur-coupled phenate detergent, or an alkylsalicylate detergent.

7. The lubricating composition of claim 3, wherein at least one anti-wear agent is present in an amount of from 0.05 to 3 weight percent based on the total weight of the lubricating composition.

8. The lubricating composition of claim 7, wherein the at least one anti-wear agent comprises a phosphorus-containing compound in an amount effective to deliver 200 to 1200 ppm phosphorus to the lubricating composition.

9. The lubricating composition of claim 7, wherein the at least one anti-wear agent comprises a zinc dialkyl dithiophosphate.

10. The lubricating composition of claim 3, wherein the ashless antioxidant different from the benzazepine compound is present in an amount of from 0.01 to 5 weight percent based on the total weight of the lubricating composition.

11. The lubricating composition of claim 1, wherein the lubricating composition comprises less than 0.1 weight percent of a diarylamine antioxidant.

12. The lubricating composition of claim 1, wherein the lubricating composition is substantially free of a diarylamine antioxidant.

13. A method of lubricating an internal combustion engine comprising supplying to the internal combustion engine the lubricating composition of claim 1.

14. A method of improving the oxidative resistance of a crankcase lubricant, wherein the method comprises lubricating the crankcase with the lubricating composition of claim 1.

* * * * *